United States Patent [19]

Lasheras Barrios

[11] 4,327,643

[45] May 4, 1982

[54] ANTI-AIRCRAFT PROJECTILE WITH BASE, HIGH-EXPLOSIVE BODY, AND OGIVE

[76] Inventor: Fernando Lasheras Barrios, San Antonio Maria Claret, 43-45 Zaragoza, Spain

[21] Appl. No.: 104,460

[22] Filed: Dec. 17, 1979

[30] Foreign Application Priority Data

Dec. 27, 1978 [ES] Spain ..... 476.388

[51] Int. Cl.[3] ..... F42B 13/48

[52] U.S. Cl. ..... 102/493; 102/494; 102/473

[58] Field of Search ..... 102/67, 493, 494, 473

[56] References Cited

U.S. PATENT DOCUMENTS

| | | | |
|---|---|---|---|
| 3,000,309 | 9/1961 | Zapf | 102/67 |
| 3,566,794 | 3/1971 | Pearson et al. | 102/67 |
| 3,667,390 | 6/1972 | Medin et al. | 102/67 |
| 3,815,504 | 6/1974 | Tieben | 102/67 |
| 3,882,779 | 5/1975 | Frostig | 102/67 X |
| 4,016,816 | 4/1977 | Larsson et al. | 102/67 |
| 4,112,847 | 9/1978 | Thomanek | 102/67 |
| 4,129,061 | 12/1978 | Bedall et al. | 102/67 X |

FOREIGN PATENT DOCUMENTS

| | | | |
|---|---|---|---|
| 744615 | 7/1970 | Belgium | 102/67 |

*Primary Examiner*—Peter A. Nelson

*Attorney, Agent, or Firm*—Wenderoth, Lind & Ponack

[57] ABSTRACT

An anti-aircraft projectile for intercepting flying objects, such as aircraft and missiles, includes three independent zones which can be coupled to one another and which respectively form a base, a high-explosive body and an ogive. The base includes a bourrelet and has a recess which forms a skirt provided with bypass holes. The high-explosive body is formed by a pair of concentric cylinders wherebetween there is formed a chamber in which are disposed steel balls or spheres which fill the chamber. Both cylinders are coupled at the corresponding ends thereof to both the base and the ogive.

5 Claims, 6 Drawing Figures

ANTI-AIRCRAFT PROJECTILE WITH BASE, HIGH-EXPLOSIVE BODY, AND OGIVE

BACKGROUND OF THE INVENTION

This invention refers to an anti-aircraft projectile and more specifically to a projectile for intercepting any flying objects, preferably missiles.

A projectile made in accordance with the invention has a high offensive power which can be considered as highly superior to that of known projectiles having the same purpose. The number of fragments which are discharged when the projectile explodes is greater than of heretofore known projectiles, and the range and distribution of such fragments which are discharged when the projectile explodes will also be much greater.

At present, projectiles to be launched against flying aircraft are so constructed that the weight of the high-explosive body, i.e. that part of the projectile between the ogive and the base, is distributed in approximately equal parts. These parts can be considered as being situated forwardly and rearwardly of an imaginary transverse axis dividing the projectile at a zone situated at a level slightly forward of the bourrelet of the projectile. The high-explosive body should be understood as referring to that zone of the projectile in which the explosive charge is housed, while the bourrelet refers to a type of ring attached to the exterior of the projectile at a position closely forward of the base, the purpose of which is to store, since it is inside the cannon which discharges the projectile, the pressure produced at the beginning of the firing of the projectile for the forced discharge thereof from the cannon.

In this type of known projectile, the distribution of the explosive charge is deficient inasmuch as the portion of explosive charge stored in the rearward part of the projectile, i.e. in the zone close to the base, only represents 20% of the total weight of the explosive charge, while the amount of charge stored in the forward part of the projectile is 80%. Thus, the mentioned imaginary transverse axis divides the high-explosive body into two parts, one corresponding to the base or rear portion, and the other corresponding to the high-explosive body and the ogive. With this arrangement the rear portion or base comprises 50% of the total weight of the high-explosive body and only 20% of the total weight of the explosive charge, while the forward part of ogive comprises the remaining 50% of the total weight of the high-explosive body and 80% of the total weight of the explosive charge.

Due to this distribution in weight, the weight ratio of the body to be fragmented to that of the explosive charge in the base reaches values of approximately fifteen grams of body to be fragmented to one gram of explosive charge, while such weight ratio in the forward zone of the projectile or that corresponding to the ogive is less than four grams body to be fragmented to one gram of explosive charge.

Such poor distribution is unavoidable in known projectiles, since the base of the projectile must be provided with a great resistance which is necessary, on the one hand, to absorb the high stresses which occur during discharge and, on the other hand, to provide the projectile with the most suitable aerodynamic profile to enable the projectile to acquire high speeds when discharged.

SUMMARY OF THE INVENTION

The present invention provides, without adversely effecting the aerodynamic profile of the area of the base of the projectile, the most satisfactory distribution of the weight of the charge contained in each of the forward and rearward parts of the projectile, with respect to the previously mentioned imaginary transverse axis which divides the projectile. Thus, a better equilibrium of the weight of both parts of the projectile is achieved with respect to the weight of the explosive which both parts contain. By way of illustration, for example, in a 76 mm caliber projectile made in accordance with the characteristics of the invention, which will subsequently be explained in more detail, such weight ratio will be as follows:

THE BASE PORTION: 32% of the weight of the high-explosive body or body to be fragmented and 20% of the weight of the explosive charge contained therein.

FORWARD PART OF THE BODY CLOSE TO THE OGIVE:

68% of the weight of the high-explosive body or body to be fragmented and 80% of the weight of the explosive charge.

Such proportions provide a ratio of approximately eight grams of high-explosive body or body to be fragmented to one gram of charge with respect to the part base, while such ratio will be approximately four grams of body to one gram of charge with respect to the forward part or the ogive.

In other words, according to the invention, approximately one half or 50% of the weight of the body to be fragmented per gram of explosive will be in the base part, while the already existing ratio for the forward part or ogive does not vary.

Such result is obtained by incorporating in an already known projectile certain improvements in design, which are essentially the object of this invention.

Such improvements in structure or design consist in providing the free end of the base with a recess which forms a skirt in which holes are provided to thereby balance the interior and exterior pressures when the projectile leaves the barrel of the cannon from which it is discharged. Such recesses in the free or rear zone of the base forms a resistant section having the most satisfactory profile to become highly resistant, even with a material having a minimum thickness. This formation facilitates an improvement in the ballistic coefficient of the projectile, the corresponding base having a minimum weight.

The improvement in the ballistic coefficient of the projectile is obtained since, inasmuch as the skirt of the base has holes, the exterior of the base communicates with the interior thereof, and thus the creation of a vacuum and turbulances, which normally brake and deviate the path of a classic projectile in which the base is a solid mass, is prevented.

Another structural characteristic of the invention is that the high-explosive body will have an outer casing, a chamber being formed between the casing and the high-explosive body. The chamber is filled with suitably sized steel balls or spheres which will preferably be arranged in a staggered manner with respect to the axial direction. The rearmost of balls is positioned in indentations previously formed in a forward portion of the base in order to obtain suitable positioning and immobility necessary to insure that the balls will accompany the launched projectile during rotation thereof.

Another important characteristic of the invention is that the base, the high-explosive body and the ogive are independent members which are mutually coupled to form the assembly of the projectile.

In other words, a projectile according to the invention comprises a base member which is formed with a recess forming a skirt provided with by-pass holes, which will be in the zone of the projectile which will directly receive the action of the gases of the charge which launches the projectile. A member coupled to such base will constitute the high-explosive body of the projectile, inside which the majority of the explosive charge will be stored.

A bourrelet will be disposed on the exterior of the base.

The intermediate high-explosive body will be coupled, at an end thereof opposite to the end connected to the base, to another member acting as the ogive which, in turn, will support a fuse.

As previously mentioned, the high-explosive body or intermediate element of the projectile of this invention, considering the fuse and the base as the end zones, will be surrounded by a casing between which two parts, i.e. the casing and the high-explosive body, are disposed the steel balls or spheres which will provide a greater offensive power when the high-explosive body is fragmented due to explosion. The inner surface of the part forming the high-explosive body has formed therein a series of grooves, both in the direction of the generatrix or axially of the body and annularly or circumferentially, such grooves define pre-fragmentation zones, so that the high-explosive body will be divided when the projectile explodes, and such zones also propel the balls contained in the chamber formed between the casing and the high-explosive body with force and effect.

BRIEF DESCRIPTION OF THE DRAWINGS

Other objects, features and advantages of the invention will be apparent from the following description, taken with the accompanying drawings, wherein.

DETAILED DESCRIPTION OF THE INVENTION

Figure 1:
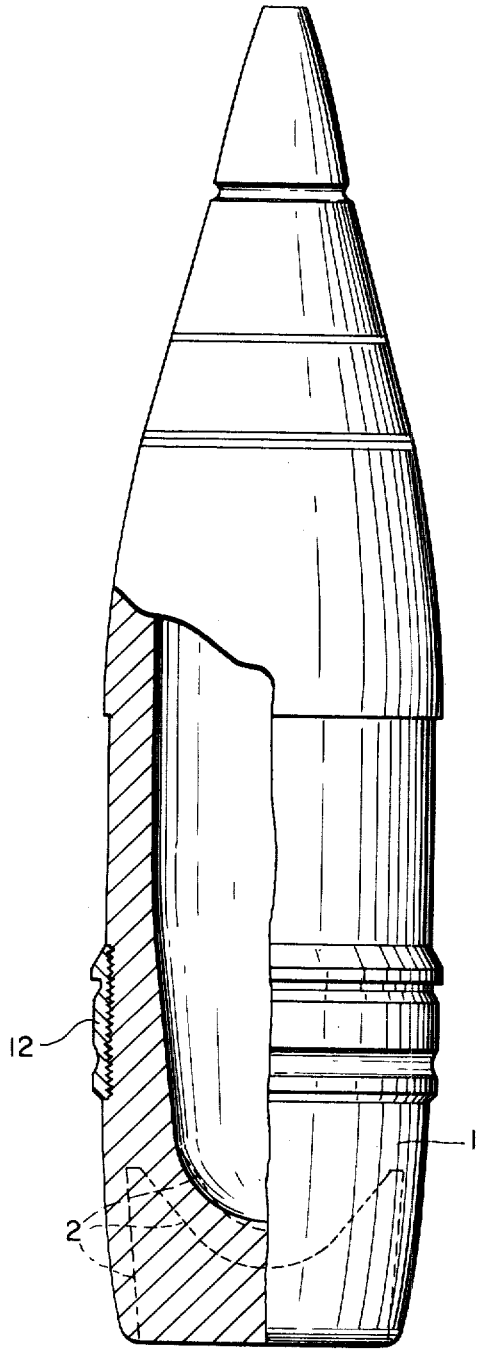
FIG. 1 is a partial sectional view of a conventional projectile, wherein the explosive charge has not been shown, and wherein dashed lines illustrate a change in the profile of the projectile base in accordance with the invention.

In the various figures of the drawings like numerical references represent like parts. The base 1 of a classic projectile illustrated in FIG. 1 is a solid mass. Departing from this design, the conventional base 1 is provided with a recess as indicated by the dashed lines 2 of FIG. 1. The formation of such recess will result in the formation of a base 3 having other characteristics. Thus, as illustrated in FIG. 2, there is formed a type of skirt 4 which is provided with a series of by-pass holes 5 which serve to balance the inner and outer pressures of the projectile, once the same has been released from the launching cannon, thus preventing the formation of a vacuum which is formed behind the base of the conventional projectile of FIG. 1 and turbulences which unavoidably produce a faulty discharge path of the projectile.

Figure 2:
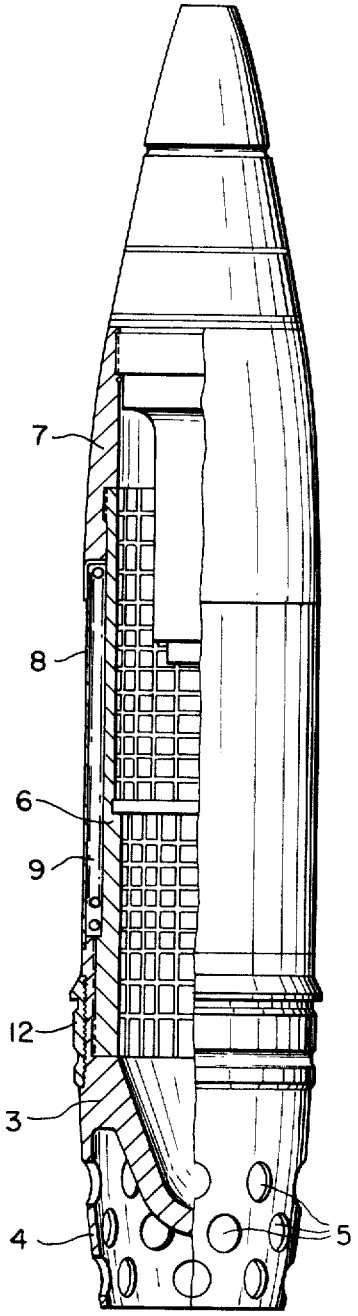
FIG. 2 is a partial sectional view of a projectile in accordance with the invention.
Figure 2A:
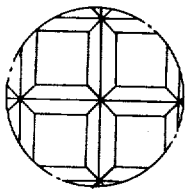
FIG. 2*a* is an enlarged view of the circled portion of FIG. 2.

Reference numeral 12 indicates a bourrelet provided on the base of both the classic projectile of FIG. 1 and that of the projectile made in accordance with the invention of FIG. 2.

The recess made in the base, according to the embodiment of FIG. 2, proportions a resistant section having a profile which is highly suitable to obtain a great resistance of the zone of the base of the projectile with a minimum of material forming the same. Thus, this formation significantly improves the ballistic coefficient of the projectile since, for example, the center of gravity is advanced, i.e. it is placed forwards or towards the ogive 7, thereby further reducing the dead or unused weight of the projectile. This is possible precisely due to the reduction in the weight of the base 3, to which the bourrelet 12 is still fixed.

The fragmentation assembly of the projectile is formed, in accordance with the invention, by a body 6 which is coupled, for example by threads, to the base 3 and opposite to the ogive 7, and by a casing 8 made, for example, from a piece of tube or an axially perforated bar being placed concentrically to the body 6. Casing 8 is retained rearwardly by the base 3 and forwardly by the ogive 7.

In an annular chamber 9 formed between the high-explosive body 6 and the casing 8, there is disposed a series of steel balls or spheres 10 which, when the projectile explodes, are dispersed together with fragments of the high-explosive body 6. The inner surface of body 6 has therein a series of weakening grooves extending both in the direction of the generatrix or axially and in a transverse or circumferential direction. The zones defined between the weakening grooves become fragmentation portions upon detonation of the projectile.

That casing 8 has a suitable thickness to support the centrifugal force which will be generated by the rotation of the balls 7 which will accompany the rotation of the projectile.

Figure 3:
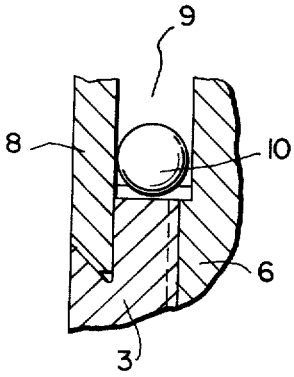
FIG. 3 is an enlarged section of the area of coupling the casing to the base of the projectile of FIG. 2.
Figure 5:
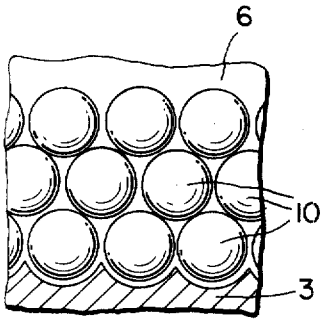
FIG. 5 is an enlarged partial section illustrating positioning of the spheres in a staggered manner.

Fastening of the casing 8 to the base is achieved by the coupling illustrated in the enlarged detail of FIG. 3. The lower edge of casing 8 is inwardly and rearwardly bevelled and is received in a complementary shaped annular recess formed on the outer face of base 3, and specifically in an area thereof forwardly of the bourrelet 12.

As can be seen in FIG. 2 the ogive 7 is coupled, for example by threads, to a forward part of the cylinder which forms the high-explosive body 6, and a fuse 11 is, as normal, situated forwardly of the ogive.

It will be understood that the explosive charge will be placed in the interior of the ogive, as well as in the interior of body 6 and even in the interior of a portion of the base itself.

The coupling between the casing 8 and the base 3, accordingly to the embodiment illustrated in FIG. 3, prevents elastic deformation which could be produced by the balls 7 as well as the casing 8 due to the centrifugal force which will be created by the rotation of the projectile when discharged.

As is clear from the above, both the fuse 11 and the ogive 7, as well as a portion of the explosive charge, will turn on the high-explosive body 6 and on the base 3 of the projectile, while the balls or spheres 10 and the casing 8 will turn on the base 3. The forward end of casing 8 is guided in a peripheral or annular housing provided on the rearward face of the ogive 7. Therefore, the casing 8 can be as thin as possible, since it only has to bear the forces of its own inertia and the centrifugal force of the balls 10, so as not to slightly brake or retard the discharge outwardly of balls 10 during the detonation of explosion of the projectile. It will be understood that the balls or spheres 10 will be discharged outwardly by the force of the fragmentation to be produced in the high-explosive body 6, thus increasing the pentration power of the projectile of the invention when compared with a conventional projectile.

It should be pointed out that the pre-fragmentation zones of the high-explosive body 6, formed by the areas of body 6 between the grooves on the inner surface thereof, can either coincide or not with the number of balls 10 disposed in the annular chamber formed between high-explosive body 6 and casing 8.

Figure 4:
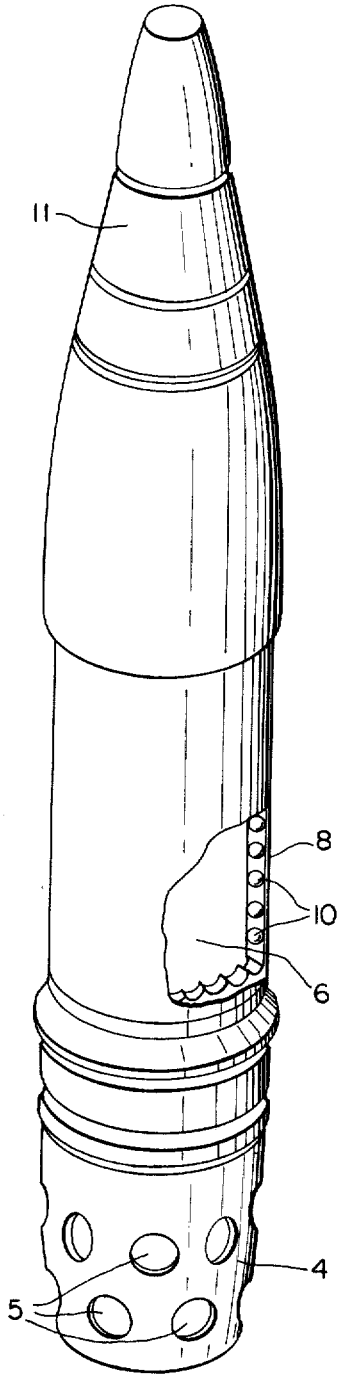
FIG. 4 is a perspective view, partially broken away, of a projectile in accordance with the invention, specifically illustrating the positioning of steel balls or spheres.

The balls or spheres 10 are arranged in a staggered manner, and rotation thereof takes place automatically during discharge. It should be pointed out that the lower row of balls should bear the force of inertia of the other rows of balls, i.e. those which are situated forwardly in the annular chamber, thereby producing a slight indentation on the support of the first row of balls on the base 3 of the projectile. Such support of the balls or corresponding zone of the base 3 need not be made from a highly resistant material. Such support has a series of radial indentations, as can be seen for example in FIG. 4, so that the friction of the balls 7 on the casing 8 which is solidly attached to the base 3 will force such balls to turn in unison with the projectile.

In conclusion, the projectile according to the invention is constructed from three main parts: the high-explosive body with its concentric casing, the base, and the ogive. These parts are independent from one another, but can be coupled to one another.

Also, the design of the base of the projectile in accordance with the invention, when compared with a conventional base, is such that the base is provided with a recess which has a configuration shown by dashed lines 2 in FIG. 1. Both the inner profile of the base, always referring to the base of the conventional projectile, as well as the free end or zone thereof undergo a slight modification.

Another important characteristic of the projectile of the invention is the provision of a chamber concentric to the high-explosive body in which there are disposed a series of balls or spheres which, on being discharged at the time explosion of the projectile, together with the fragments of the high-explosive body, increase the penetration power of the projectile.

I claim:

1. An anti-aircraft projectile for intercepting flying objects such as airplanes and missiles, said projectile comprising:

a forward ogive, a rearward base, and a fragmentation assembly extending between said ogive and said base;

said base having therein a rearward facing recess forming a finless rearwardly extending skirt, said skirt having therethrough by-pass holes for balancing the pressure interiorly and exteriorly of said skirt, and for preventing the formation behind said base of reduced pressure and turbulence during the flight of the projectile; and said fragmentation assembly comprising a high-explosive body containing therein an explosive charge, a casing coaxially surrounding said body and defining therewith an annular chamber, said body and said casing each having forward ends coupled to said ogive and rear ends coupled to said base, and steel balls or spheres freely packing and filling said chamber.

2. A projectile as claimed in claim 1, wherein said body has an inner surface having formed therein grooves extending axially and circumferentially of said body.

3. A projectile as claimed in claim 1, wherein said base includes a forwardmost end surface having formed therein a plurality of grooves seating and circumferentially retaining the said balls of a rearmost circumferential row of balls.

4. A projectile as claimed in claim 1, wherein said rear end of said casing includes an edge bevelled inwardly and rearwardly, and said bevelled casing edge is received and retained in a complementary shaped, forward facing annular recess in said base.

5. A projectile as claimed in claim 1, further comprising a bourrelet fixed to the exterior of said base at a forward position thereof.

* * * * *